US007417588B2

(12) United States Patent
Castany et al.

(10) Patent No.: US 7,417,588 B2
(45) Date of Patent: Aug. 26, 2008

(54) MULTI-BAND MONOPOLE ANTENNAS FOR MOBILE NETWORK COMMUNICATIONS DEVICES

(75) Inventors: Jordi Soler Castany, Mataro (ES); Carles Puente Baliarda, Barcelona (ES); Carmen Borja Borau, Barcelona (ES)

(73) Assignee: Fractus, S.A., Bracelona (ES)

( * ) Notice: Subject to any disclaimer, the term of this patent is extended or adjusted under 35 U.S.C. 154(b) by 0 days.

(21) Appl. No.: 10/587,119

(22) PCT Filed: Jan. 28, 2005

(86) PCT No.: PCT/ES2005/000879

§ 371 (c)(1),
(2), (4) Date: Aug. 29, 2006

(87) PCT Pub. No.: WO2005/076409

PCT Pub. Date: Aug. 18, 2005

(65) Prior Publication Data

US 2007/0152887 A1 Jul. 5, 2007

Related U.S. Application Data

(60) Provisional application No. 60/540,448, filed on Jan. 30, 2004.

(51) Int. Cl.
*H01Q 1/38* (2006.01)

(52) U.S. Cl. ..... 343/700 MS; 343/702; 343/846

(58) Field of Classification Search ..... 343/700 MS, 343/846, 702
See application file for complete search history.

(56) References Cited

U.S. PATENT DOCUMENTS 4,157,548 A 6/1979 Kaloi
4,356,492 A 10/1982 Kaloi
5,870,066 A 2/1999 Asakura et al.

(Continued)

FOREIGN PATENT DOCUMENTS

CA 2416437 A1 1/2002

(Continued)

OTHER PUBLICATIONS

Ning Hua Zhu et al, New algorithms of the TSM and Tom methods for calibrating microwave test fixtures, Microwaves and optical tecnhnology letters,, Jul. 2002, vol. 34, No. 1.

(Continued)

*Primary Examiner*—Hoang V Nguyen
(74) *Attorney, Agent, or Firm*—Winstead PC

(57) ABSTRACT

Multiband monopole antennas are disclosed. The antennas disclosed can include a substrate for mounting conductors, one or more conductors for receiving networking signals mainly in a first frequency band, and one or more conductors for receiving networking signals mainly in a second frequency band. The conductors can have a polygonal shape or the conductors can have a linear, space-filling, or grid dimension shape. The conductors can be connected at a feed point. One or more antenna can be incorporated into a single printed circuit board. When multiple antennas are used with the same printed circuit board, the conducting material of the printed circuit board located between the antenna attachment points can be interrupted to improve the isolation of each antenna.

27 Claims, 7 Drawing Sheets

U.S. PATENT DOCUMENTS

| | | | | |
|---|---|---|---|---|
| 5,990,838 | A | 11/1999 | Burns et al. | |
| 5,990,848 | A | 11/1999 | Annamaa et al. | |
| 6,016,130 | A | 1/2000 | Annamaa | |
| 6,130,651 | A | 10/2000 | Yanagisawa et al. | |
| 6,166,694 | A | 12/2000 | Ying | |
| 6,184,836 | B1 | 2/2001 | Ali | |
| 6,243,592 | B1 | 6/2001 | Nakada et al. | |
| 6,307,511 | B1 | 10/2001 | Ying et al. | |
| 6,329,962 | B2 | 12/2001 | Ying | |
| 6,337,667 | B1 | 1/2002 | Ayala et al. | |
| 6,429,820 | B1 | 8/2002 | Thursby | |
| 6,456,245 | B1 | 9/2002 | Crawford | |
| 6,459,413 | B1 * | 10/2002 | Tseng et al. | 343/702 |
| 6,535,167 | B2 | 3/2003 | Masuda et al. | |
| 6,552,686 | B2 * | 4/2003 | Ollikainen et al. | 343/700 MS |
| 6,661,380 | B1 | 12/2003 | Bancroft | |
| 6,674,405 | B2 | 1/2004 | Wang | |
| 6,683,571 | B2 | 1/2004 | Ghosh | |
| 6,720,925 | B2 | 4/2004 | Wong | |
| 6,747,600 | B2 * | 6/2004 | Wong et al. | 343/700 MS |
| 6,806,834 | B2 | 10/2004 | Yoon | |
| 6,822,610 | B2 * | 11/2004 | Yeh | 343/700 MS |
| 6,864,854 | B2 | 3/2005 | Dai et al. | |
| 6,871,079 | B1 | 3/2005 | Choi et al. | |
| 6,963,310 | B2 | 11/2005 | Horita | |
| 7,015,863 | B2 | 3/2006 | Sadler | |
| 7,057,560 | B2 | 6/2006 | Erkicevic | |
| 7,068,230 | B2 | 6/2006 | Qi | |
| 7,071,877 | B2 * | 7/2006 | Okado | 343/700 MS |
| 7,148,849 | B2 | 12/2006 | Lin | |
| 2002/0140615 | A1 | 10/2002 | Carles et al. | |
| 2002/0149527 | A1 | 10/2002 | Wen | |
| 2002/0175866 | A1 | 11/2002 | Gram | |
| 2003/0122718 | A1 | 7/2003 | Fang | |
| 2003/0132883 | A1 | 7/2003 | Wong et al. | |
| 2003/0210187 | A1 | 11/2003 | Wong et al. | |
| 2004/0004574 | A1 | 1/2004 | Wen | |
| 2004/0014428 | A1 | 1/2004 | Franca-Neto | |
| 2004/0090372 | A1 | 5/2004 | Nallo | |
| 2004/0095289 | A1 | 5/2004 | Bae et al. | |
| 2004/0140938 | A1 | 7/2004 | Kadambi | |
| 2004/0212545 | A1 | 10/2004 | Li | |
| 2004/0217916 | A1 | 11/2004 | Quintero Illera et al. | |
| 2004/0222922 | A1 * | 11/2004 | Kuo et al. | 343/700 MS |
| 2005/0007279 | A1 | 1/2005 | Chang | |
| 2005/0237244 | A1 | 10/2005 | Annabi | |
| 2005/0253761 | A1 | 11/2005 | Tung | |
| 2006/0019730 | A1 | 1/2006 | Kin et al. | |
| 2006/0033668 | A1 | 2/2006 | Ryu | |
| 2006/0082504 | A1 | 4/2006 | Chen | |

FOREIGN PATENT DOCUMENTS

| | | | |
|---|---|---|---|
| EP | 1294048 | A2 | 3/2003 |
| EP | 1324423 | | 7/2003 |
| EP | 1 367 671 | | 12/2003 |
| EP | 1657785 | A1 | 5/2006 |
| JP | 2001-217632 | | 8/2001 |
| JP | 2003-347828 | | 12/2003 |
| WO | 9016091 | A1 | 12/1990 |
| WO | 9718601 | A1 | 5/1997 |
| WO | 9807208 | A1 | 2/1998 |
| WO | 9831067 | A1 | 7/1998 |
| WO | WO-99/56345 | | 11/1999 |
| WO | 99/67851 | | 12/1999 |
| WO | 0005781 | A1 | 2/2000 |
| WO | 0030208 | A1 | 5/2000 |
| WO | WO-00/77884 | | 12/2000 |
| WO | 0111899 | A1 | 2/2001 |
| WO | WO-01/11721 | | 2/2001 |
| WO | 01/26182 | A1 | 4/2001 |
| WO | WO-01/48861 | | 7/2001 |
| WO | WO-01/54225 | | 7/2001 |
| WO | 02052679 | A1 | 7/2002 |
| WO | WO-02/078123 | | 10/2002 |
| WO | WO-03/023900 | | 3/2003 |
| WO | WO-03/041216 | | 5/2003 |
| WO | WO-2004/010531 | | 1/2004 |
| WO | 2004019261 | A2 | 3/2004 |
| WO | WO-2004/042868 | | 5/2004 |
| WO | 2004047222 | A1 | 6/2004 |
| WO | 2005076407 | A2 | 8/2005 |
| WO | 2005093901 | A1 | 10/2005 |
| WO | 2005099041 | A1 | 10/2005 |

OTHER PUBLICATIONS

Hao Chun Tung et al, Printed dual-band monopole antenna for 2.4/5.2 GHz Wlang access point, Microwaves and optical technology letters, Nov. 2002, vol. 35, No. 4.

Chih-Ming Su et al, Dual-band slot for 2.4/5.2 GHz wlang operation,Microwaves and optical technology letters, Nov. 2002, vol. 35, No. 4.

Ning Hua Zhu, New algorithms of the TSM and Tom methods for calibrating microwave test fixtures, Microwaves and Optical Technology Letters, Jul. 2002, vol. 34, No. 1.

Yeh, Integrated f-shaped monopole antenna for 2.4/5.2 GHz dual-band operation, Microwave and Optical Technology Letters, Jul. 2002, vol. 34, No. 1.

Sim et al., A wideband monopole antenna for PCS/IMT-2000/Bluetooth applications, IEEE Antennas and Wireless Propagation Letters, 2004, vol. 3.

Ali et al. A uniquely packaged internal inverted-F antenna for bluetooth or wireless LAN application, IEEE Antennas and Wireless Propagation Letters, 2002, vol. 1.

Guo et al. Compact internal multiband antennas mobile handsets, IEEE Antennas and Wireless Propagation Letters, 2003, vol. 2.

Soler Castany, Novel multifrequency and small monopole antenna techniques for wireless and mobile applications [DoctoralTesis], Universitat Politécnica de Catalunya, Fractus, Dec. 2004.

Wu et al. A planar meander-line antenna for triple-band operation of mobile handsets, Microwave Optical Technology Letters, Jun. 2004, vol. 41, No. 5.

Cho et al. A wideband internal antenna with dual monopole radiation elements, IEEE Antennas and Wireless Propagation Letters, 2005, vol. 4.

Shin, A broadband interior antenna of planar monopole type in handsets, IEEE Antennas and Wireless Propagation Letters, 2005, vol. 4.

Wong, Planar antennas for wireless communications, Wiley-Interscience, 2003.

Plicanic, Vanja, "Antenna Diversity Studies and Evaluation", Master Thesis, Department of Electroscience, Lund University, May 2004, 72 pages.

Puente, C. et al., "Mulitband Properties of a Fractal Tree Antenna Generated by Electrochemical Deposition", Electronic Letters, Dec. 5, 1996, vol. 32, No. 25, pp. 2298-2299.

Kwon, Y., et al, "An internal triple-band planar inverted-F antenna", IEEE Antennas and wireless propagation letters, vol. 2, 2003.

"Application note MICA 2.4/5 GHz SMD Antenna", GigaAnt, Sep. 24, 2002.

Chang, F., et al, "Folded meandered-patch monopole antenna for triple-band operation", IEEE Antennas and Propagation Society International Symposium, Jun. 2003.

Karakoussis, G. P., et al, "A dual-band inverted-F antenna printed on a PC card for the ISM and UNNI bands", Wireless communications and networking, Mar. 16, 2003.

Takehiko Tsukiji Yasunori Kumon, "Analysis of the double folded monopole antenna", Proceedings of the 2000 Millennium Conference on Antennas, Apr. 2000.

Chang, F. et al, "A low-profile folded monopole antenna for GSM/DCS mobile phone application", IEEE AP-S, Jun. 2004.

Bai, B. et al, "A dual band meandering folded loop antenna", IEEE Antennas and Propagation Society International Symposium, Jun. 2004.

Shin, Y. S. et al, "Broadband internal antenna of planar monopole type for mobile handsets", IEEE Antennas and Propagation Society International Symposium, Jun. 2004.

Azad, M. Z. et al, "A compact Hilbert planar inverted-F antenna (PIFA) for dual-band mobile phone applications", IEEE Antennas and Propagation Society International Symposium, Jun. 2004.

"Multilayer ceramic antenna for Bluetooth/WLAN IEEE 802.11b & WLAN IEEE 802.11a (2.45/5.2GHz)(Surface mounted ceramic dual band antenna)—Product specification", Phycomp Taiwan Ltd, Oct. 2003.

Hsiao, F. et al, "Metal-plate 1×2 array antenna for 5.2/5.8 GHz WLAN operation", Electronic Letters, vol. 39, No. 11, May 29, 2003.

Manteuffel, D. "Design of multiband antennas for the integration in mobile phones with optimized SAR", IEEE Antennas and Propagation Society International Symposium, Jun. 2003.

Werner, D. H. et al, "An overview of fractal antenna engineering research", IEEE Antennas and propagation magazine, Feb. 2003, vol. 45, No. 1.

Guo, Y., et al, "Miniature built-in multiband antennas for mobile handsets", IEEE Transactions on antennas and propagation, Aug. 2004, vol. 52, No. 8.

* cited by examiner

MULTI-BAND MONOPOLE ANTENNAS FOR MOBILE NETWORK COMMUNICATIONS DEVICES

CROSS-REFERENCE TO RELATED APPLICATIONS

This patent application claims the benefit of priority from U.S. Provisional Patent Application Ser. No. 60/540,448 filed on Jan. 30, 2004. This application incorporates by reference the entire disclosure of U.S. Provisional Patent Application Ser. No. 60/540,448.

INTRODUCTION

This invention relates generally to the field of multi-band monopole antennas. More specifically, multi-band monopole antennas are provided that are particularly well-suited for use in mobile network communications devices, such as PCMCIA wireless cards, electronic devices with integrated WI-FI and WiMAX modules, compact flash wireless cards, wireless USB/UART dongles, and other wireless networking devices.

BACKGROUND

Multi-band antenna structures for use in a mobile network communications device are known in this art. In known wireless PCMCIA cards, for example, two dual-band antennas are typically used. The two antennas in a PCMCIA card, for example, are used with a diversity system in which the signal received from each antenna is compared and the best signal at any given time is used. A diversity system is particularly useful for indoor and multipath reception.

SUMMARY

Multiband monopole antennas are disclosed. The antennas disclosed can include a substrate for mounting conductors, a first conductor for receiving networking signals mainly in a first frequency band, and a second conductor for receiving networking signals mainly in a second frequency band. The first conductor can have a polygonal shape with an aspect ratio of length to width of less than about 5 to about 1. The second conductor can be linear, space-filling, or grid dimension. The first and second conductors can be connected at a feeding point.

The antennas disclosed can also include a substrate for mounting conductors, first and second conductors for receiving networking signals mainly in a first frequency band, and third and fourth conductors for receiving networking signals mainly in a second frequency band. The first and second conductors can be symmetrical polygonal shapes that have an aspect ratio of length to width of less than about 5 to about 1. The third and fourth conductors can be symmetrical linear, space-filling, or grid dimension shapes. The first and second conductors can be symmetrically oriented with respect to each other about a central axis on the antenna substrate and the third and fourth conductors can be symmetrically oriented with respect to each other about the central axis on the antenna substrate. The first, second, third and fourth conductors can be connected at a feeding point.

The antennas can be formed on simple, readily available circuit board materials as separate units or formed directly onto a printed circuit board. Two or more of the disclosed antennas can be used on a single printed circuit board. When two or more antennas are used with the same printed circuit board, the conducting material of the printed circuit board located between the antenna attachment points can be interrupted to improve the isolation of each antenna.

DETAILED DESCRIPTION

Figure 1:
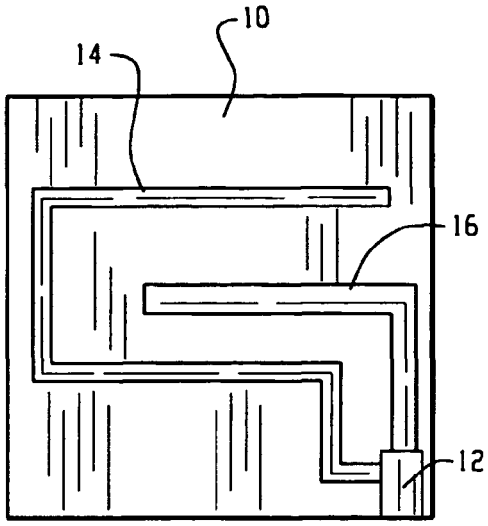
FIG. 1 shows a top view of a multi-band monopole antenna for use in mobile network communications devices.
Figure 2:
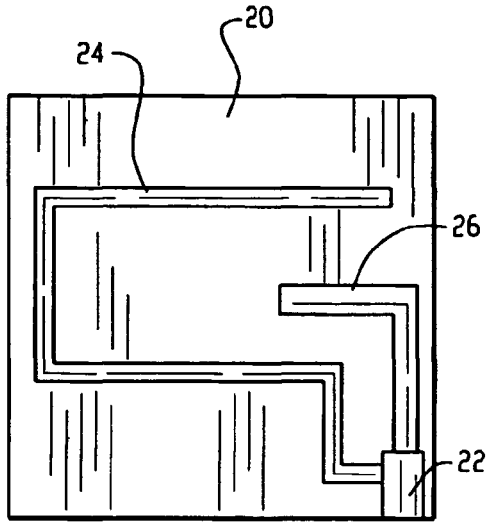
FIG. 2 shows a top view of another multi-band monopole antenna for use in mobile network communications devices.

Referring now to the drawing figures, FIG. 1 and FIG. 2 are top views of two exemplary multi-band monopole antennas for use in mobile network communications devices. The antennas of FIG. 1 and FIG. 2 include substrates (10, 20) and multibranch monopole conductors with the branches being connected at common points called feeding points (12, 22). The antenna substrates of FIG. 1 and FIG. 2 can, for example, be a 10 mm×10 mm×0.8 mm circuit board with a copper base conductor. The number of branches of a monopole antenna is directly related to the number of frequency bands or groups of bands that can be received. The antennas of FIG. 1 and FIG. 2 have two branches and are, thus, capable of receiving two different frequency bands. The branches of the antennas of FIG. 1 and FIG. 2 are non-symmetrical with the longer branch (14, 24) receiving a lower frequency band and the shorter branch (16, 26) receiving a higher frequency band. The length of the branches can be configured to receive signals specified in networking standards such as the 802.11bg/Bluetooth standard (2.4-2.5 GHz) and the 802.11a band (4.9-5.875 GHz). Thus, the antennas of both FIG. 1 and FIG. 2 can be configured, for example, to receive both 802.11bg band frequencies on the longer branch (14, 24) and 802.11a band frequencies on the shorter branch (16, 26). Coupling between branches in multibranch antennas is possible and such coupling can be taken into account during the design of the antenna. Further, services other than networking broadcast on these frequencies and the antennas disclosed herein can be used with those services as well.

Figure 3:
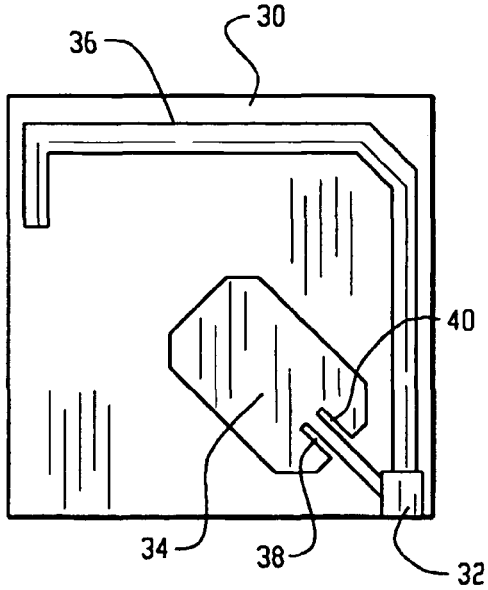
FIG. 3 shows a top view of a non-symmetrical multibranch monopole antenna for use in mobile network communications devices.

Another multi-band monopole antenna design is shown in FIG. 3. The antenna of FIG. 3 is a non-symmetrical multibranch monopole. The antenna of FIG. 3 includes a substrate 30, a feeding point 32, and two conductor branches (34, 36). The shorter branch 34 is a polygonal monopole with notches (38, 40). The polygonal monopole could also have a multilevel shape such as that described in U.S. Patent Application Publication No. US 2002/0140615 A1, which is hereby incorporated by reference. The aspect ratio, i.e., the length compared to the width, of the shorter branch 34 of the polygonal monopole as depicted in FIG. 3 is about 3 to about 2. Preferably the aspect ratio is less than about 5 to about 1, more preferably the aspect ratio is less than about 3 to about 1, and even more preferably the aspect ratio is less than about 2 to about 1. The notches (38, 40) contribute to the antenna impedance match. One or more notches can be used, the length of each notch can vary, and, if more than one notch is used, the notches may be different lengths. A polygonal monopole can also have no notches. The longer branch 36 receives a lower frequency band and the shorter branch 34 receives a higher frequency band. The longer 36 and shorter 34 branches can be configured to receive network standard signals as discussed above with the antennas of FIG. 1 and FIG. 2.

Non-symmetrical antennas like the one shown in FIG. 3 are often designed for a specific printed circuit board (PCB) and, thus, are locked into a specific orientation on the PCB because the performance of the antenna can change with changes in the position, orientation, or identity of nearby circuitry. Symmetrical antennas on the other hand usually offer greater flexibility in terms of PCB placement because they are not as effected by changes in position, orientation, or identity of nearby circuitry.

Figure 4:
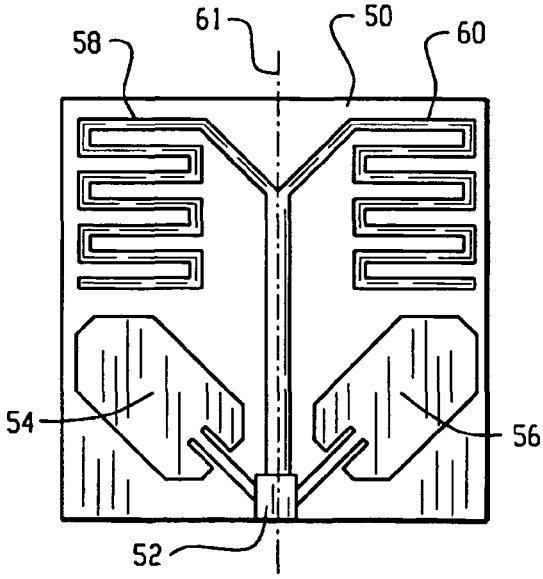
FIG. 4 shows a top view of a symmetrical multibranch monopole antenna for use in mobile network communications devices.

Another multi-band monopole antenna is shown in FIG. 4. The antenna shown in FIG. 4 is a symmetrical multibranch monopole antenna. The antenna of FIG. 4 includes a substrate 50, a feeding point 52, and four conductor branches (54, 56, 58, 60). Each conducting branch has an opposing mirror image conducting branch that is symmetrical about a plane 61 that roughly divides the substrate 50 in half from top to bottom. The shorter branches (54, 56) are mirror images of each other with respect to plane 61 and the longer branches (58, 60) are mirror images of each other with respect to plane 61. The shorter branches (54, 56) are polygonal monopoles with notches as discussed above with respect to the antenna of FIG. 3. The longer branches (58, 60) receive a lower frequency band and the shorter branches (54, 56) receive a higher frequency band. The longer branches can be linear, space-filing, or grid dimension curves. The longer (58, 60) and shorter (54, 56) branches can be configured to receive network standard signals as discussed above with respect to the antennas of FIG. 1 and FIG. 2. Due to its symmetry, the antenna of FIG. 4 has greater flexibility in terms of PCB placement than the non-symmetrical antennas discussed above.

Figure 5:
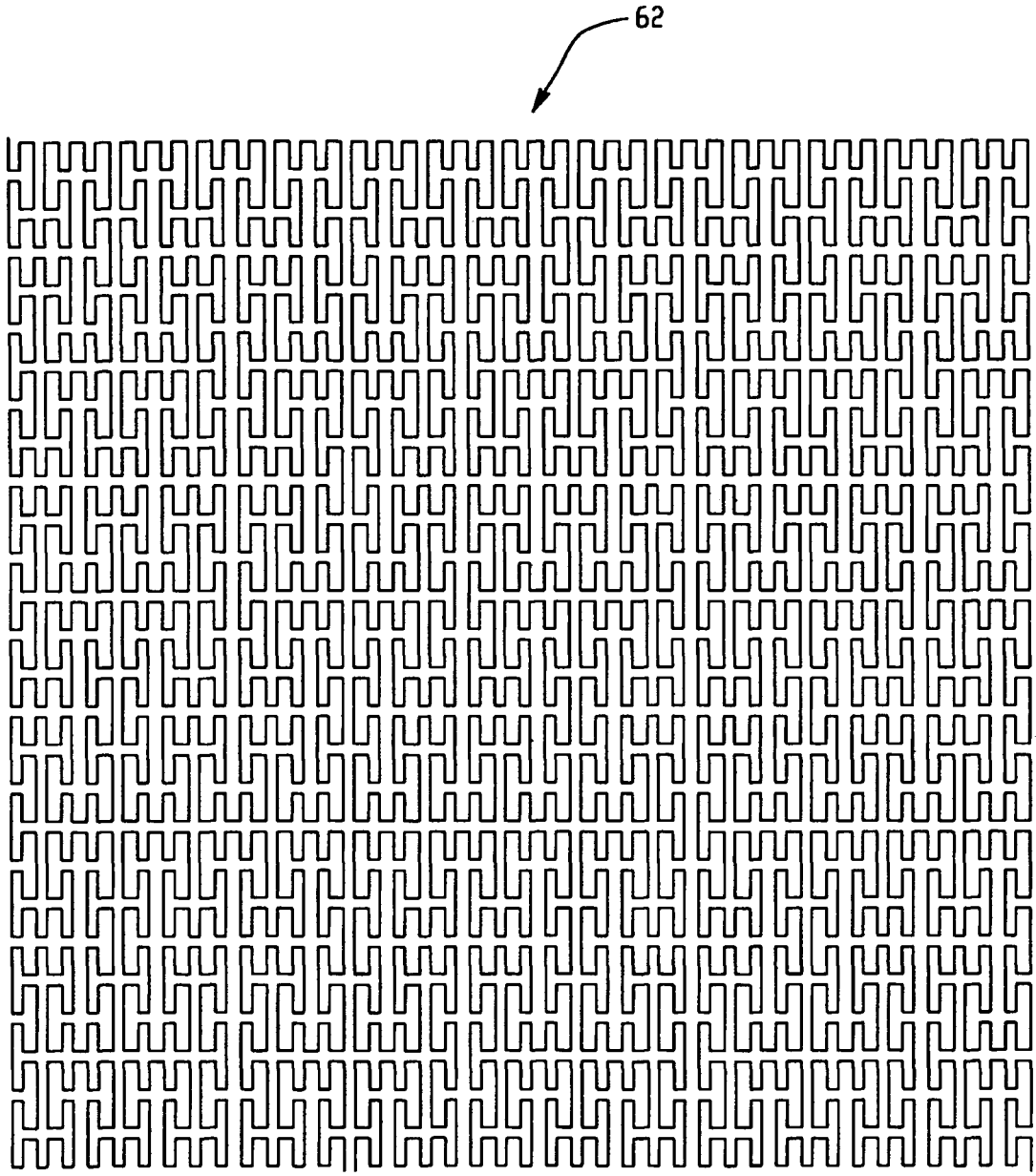
FIG. 5 shows one example of a space-filling curve.

An example of a space-filling curve 62 is shown in FIG. 5. As used herein space-filling means a curve formed from a line that includes at least ten segments, with each segment forming an angle with an adjacent segment. When used in an antenna, each segment in a space-filling curve 62 should be shorter than one-tenth of the free-space operating wavelength of the antenna.

Examples of grid dimension curves are shown in FIGS. 6 to 9. The grid dimension of a curve may be calculated as follows. A first grid having square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid should include at least twenty-five cells, and the second grid should include four times the number of cells as the first grid. Thus, the length (L2) of each square cell in the second grid should be one-half the length (L1) of each square cell in the first grid. The grid dimension ($D_g$) may then be calculated with the following equation:

$$D_g = -\frac{\log(N2) - \log(N1)}{\log(L2) - \log(L1)}$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application, a space-filling curve is one type of grid dimension curve.

Figure 6:
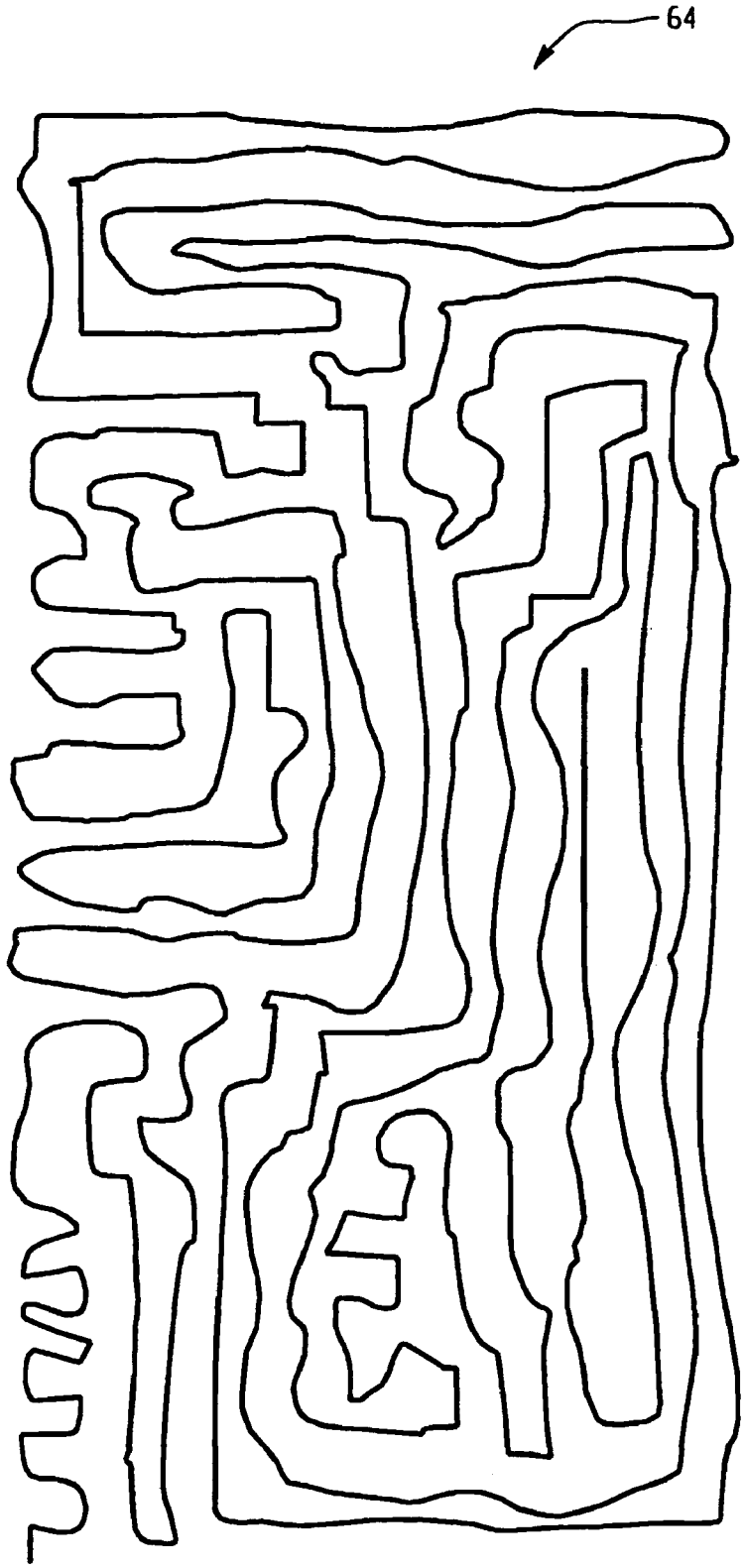
FIGS. 6-9 illustrate an exemplary two-dimensional antenna geometry forming a grid dimension curve.
Figure 7:
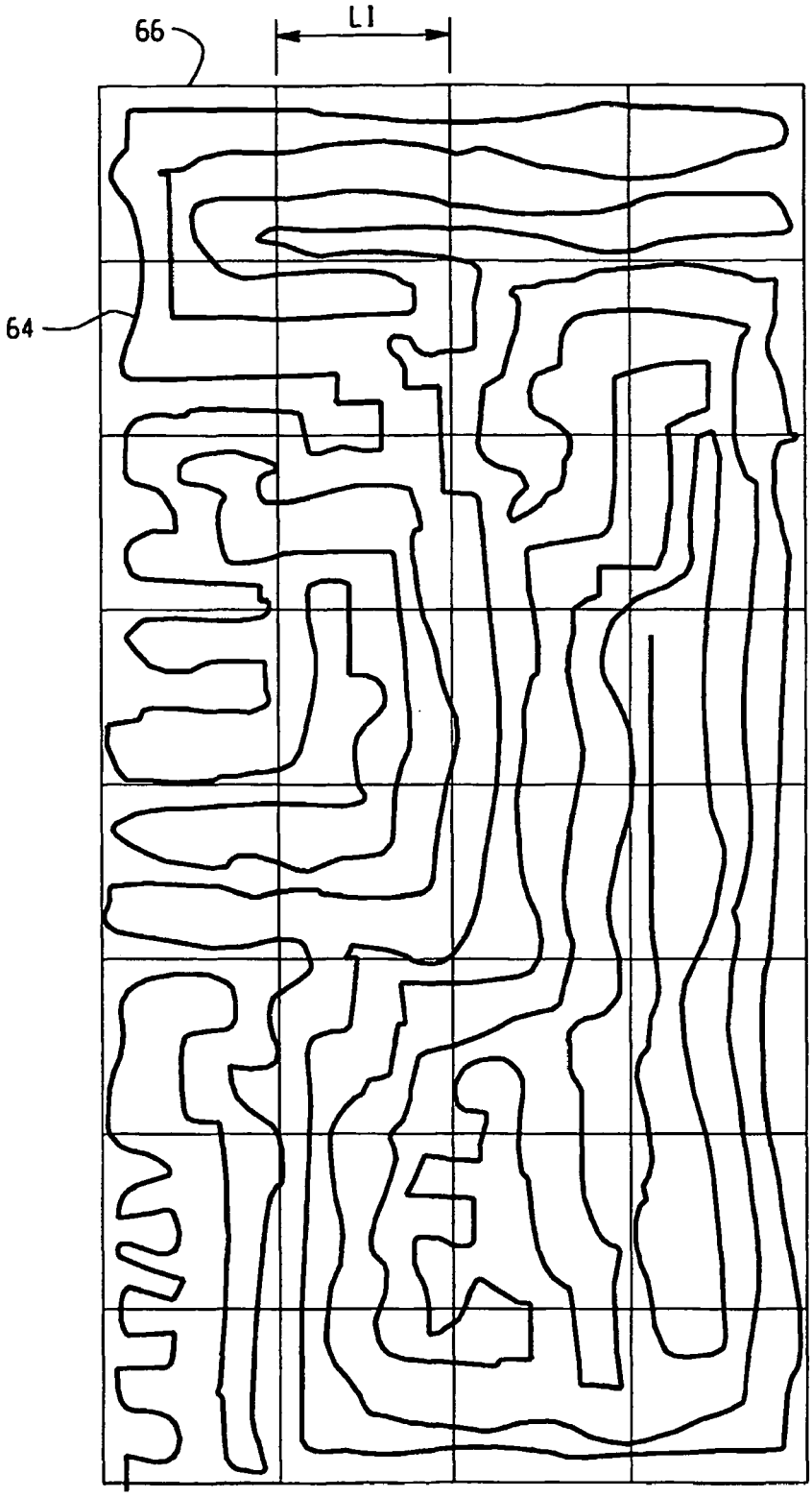
Figure 8:
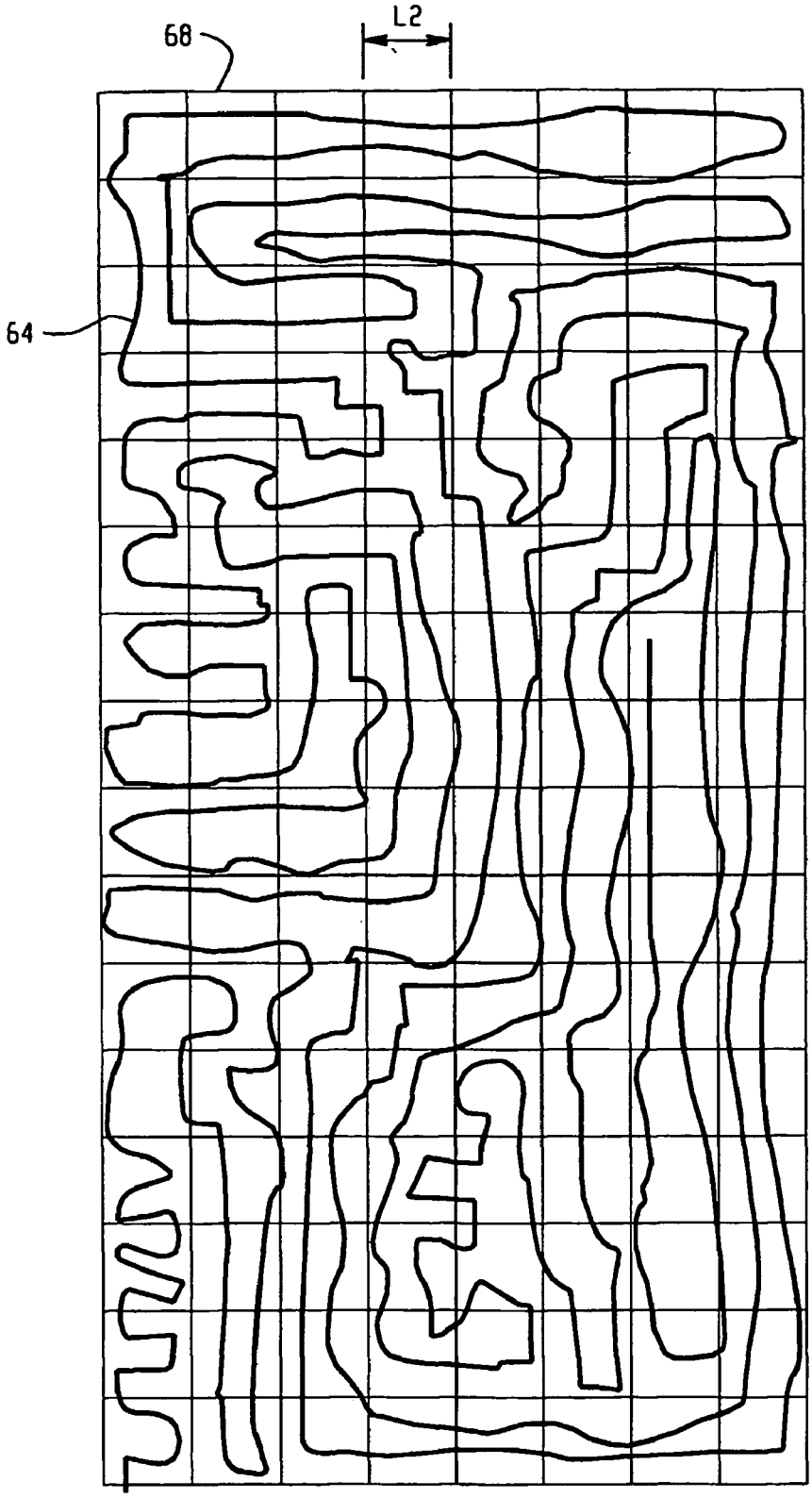

FIG. 6 shows an exemplary two-dimensional antenna 64 forming a grid dimension curve with a grid dimension of approximately two (2). FIG. 7 shows the antenna 64 of FIG. 6 enclosed in a first grid 66 having thirty-two (32) square cells, each with length L1. FIG. 8 shows the same antenna 64 enclosed in a second grid 68 having one hundred twenty-eight (128) square cells, each with a length L2. The length (L1) of each square cell in the first grid 66 is twice the length (L2) of each square cell in the second grid 68 (L2=2×L1). An examination of FIGS. 7 and 8 reveal that at least a portion of the antenna 64 is enclosed within every square cell in both the first and second grids 66, 68. Therefore, the value of N1 in the above grid dimension ($D_g$) equation is thirty-two (32) (i.e., the total number of cells in the first grid 66), and the value of N2 is one hundred twenty-eight (128) (i.e., the total number of cells in the second grid 68). Using the above equation, the grid dimension of the antenna 64 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. In some cases, the maximum number of cells is 100, but typically, the maximum number of cells in a grid is one thousand (1000).

Figure 9:
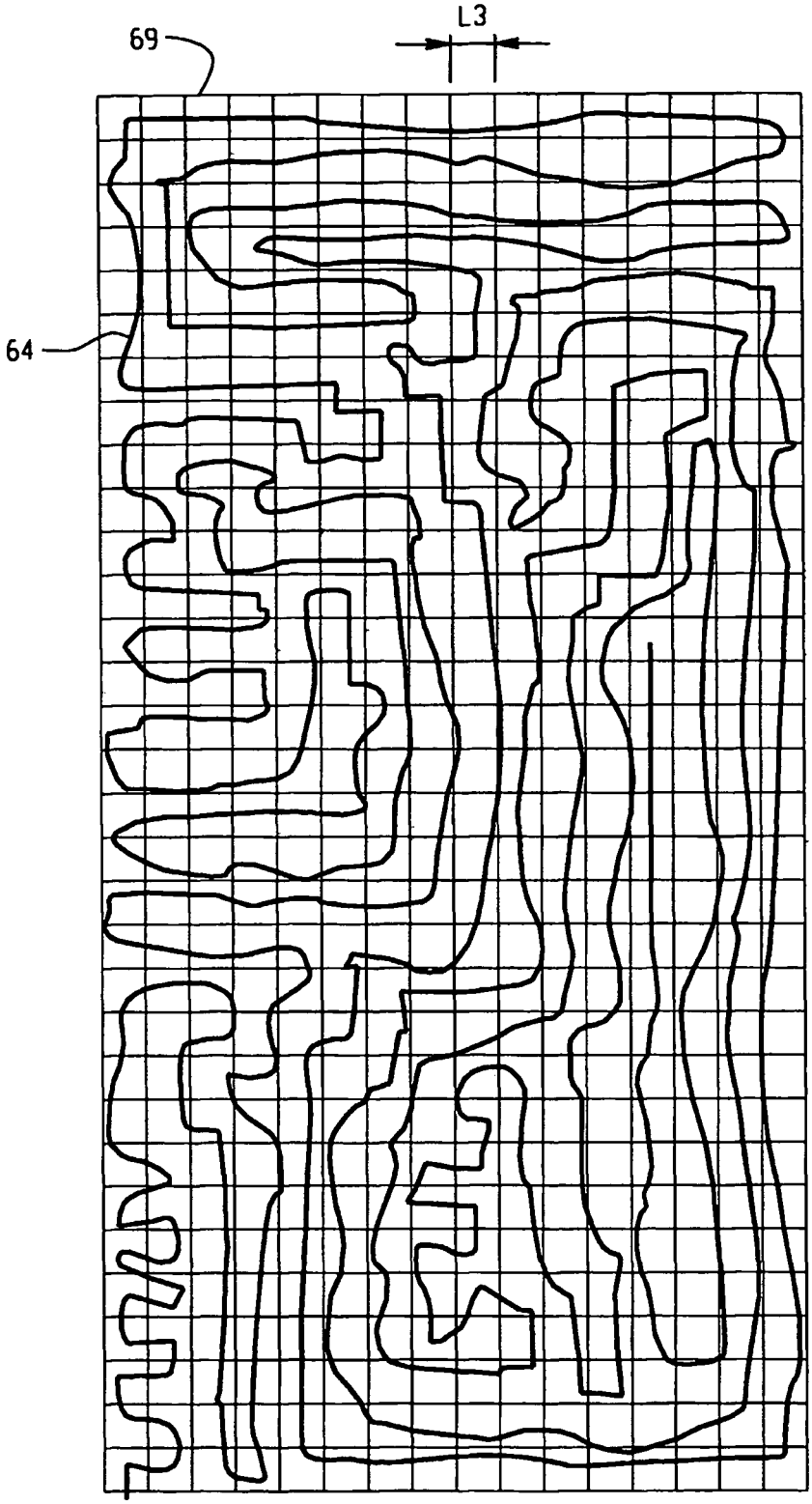

For example, FIG. 9 shows the same antenna 64 enclosed in a third grid 69 with five hundred twelve (512) square cells, each having a length L3. The length (L3) of the cells in the third grid 69 is one half the length (L2) of the cells in the second grid 68, shown in FIG. 8. As noted above, a portion of the antenna 64 is enclosed within every square cell in the second grid 68, thus the value of N for the second grid 68 is one hundred twenty-eight (128). An examination of FIG. 9, however, reveals that the antenna 64 is enclosed within only five hundred nine (509) of the five hundred twelve (512) cells in the third grid 69. Therefore, the value of N for the third grid 69 is five hundred nine (509). Using FIGS. 8 and 9, a more accurate value for the grid dimension ($D_g$) of the antenna 64 may be calculated as follows:

$$D_g = -\frac{\log(509) - \log(128)}{\log(2 \times L2) - \log(L2)} \approx 1.9915$$

Figure 11:
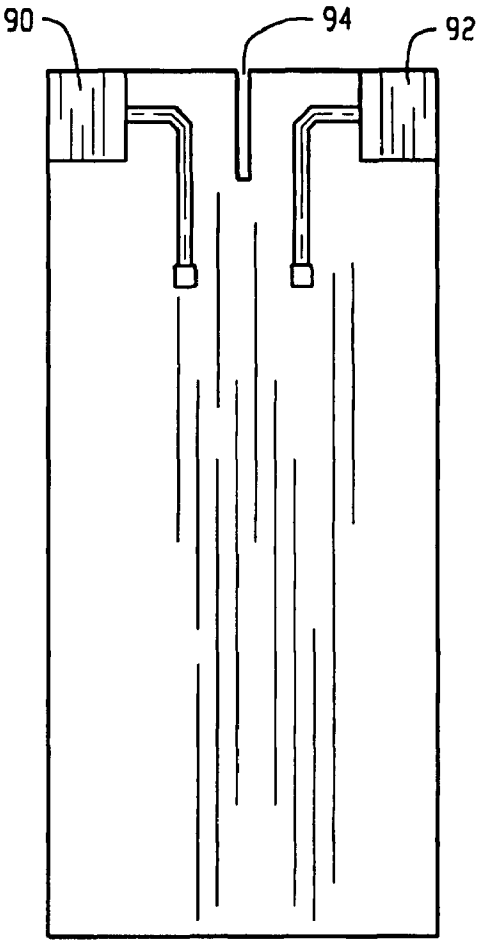
FIG. 11 shows another suggested cardbus PCB layout for use with the antenna shown in FIG. 4.
Figure 10:
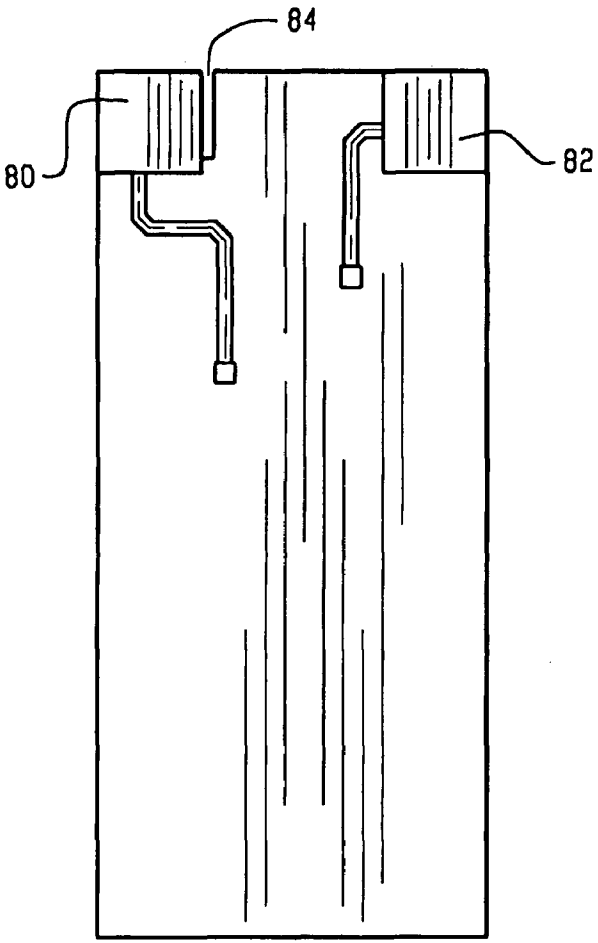
FIG. 10 shows a suggested cardbus PCB layout for use with the antenna shown in FIG. 4.

The performance aspects of multi-band monopole antennas can be effected by the layout of the metal in the PCB where an antenna is mounted. As discussed above, antennas can be designed to work within particular PCB environments or a PCB can be optimized to work with a particular antenna design. The specific design of the antenna shown in FIG. 3, for example, makes it particularly well-suited for use with a cardbus PCB. To utilize the antenna shown in FIG. 3 with a cardbus PCB, two copies of the antennas shown in FIG. 3 could, for example, be mounted in the upper left corner and upper right corner of the cardbus PCB. FIGS. 10 and 11 show examples of two PCBs suitable for use with the antenna of FIG. 4. In FIG. 10 and FIG. 11, two copies of the antenna of FIG. 4, for example, could be mounted in the upper left corners (80, 90) and upper right corners (82, 92). The PCBs of FIG. 10 and FIG. 11 include slots (84, 94) in the upper portion of the PCB. The slots (84, 94) provide an interruption in or absence of conducting material between antenna attachment positions. The slots (84, 94) allow the adjustment of the electrical path of the currents and fields that propagate along the conductive edge. An interruption in or absence of conducting material between antennas mounted on a PCB increases each antenna's isolation from the other antenna thereby potentially improving performance. In addition to slots, other interruptions that can be used include, but are not limited to, holes, FracPlane™ ground plates (such as those described in U.S. Patent Application Publication No. US 2004/0217916 A1, which is hereby incorporated by reference), and periodic, quasi-periodic, space-filling, multi-level, and frequency selective geometries. Further, one or more interruptions can be used. FIGS. 10 and 11 show examples in which separate antenna components are mounted on a PCB. When an antenna is formed as a component separate from the PCB on which it will eventually be mounted, the substrate material used to make the antenna can be simple, readily available printed circuit board material. Further, directly forming an antenna on a particular PCB is also possible. In some embodiments, the antenna is formed directly on a substrate or laminate of an integrated circuit package including other electronic or radio frequency (RF) components or semiconductor dies.

This written description uses examples to disclose the invention, including the best mode, and also to enable a person skilled in the art to make and use the invention. The patentable scope of the invention is defined by the claims, and may include other examples that occur to those skilled in the art. Such other examples, which may be available either before or after the application filing date, are intended to be within the scope of the claims if they have structural elements that do not differ from the literal language of the claims, or if they include equivalent structural elements with insubstantial differences from the literal language of the claims.

The invention claimed is:

1. A multi-band monopole antenna, comprising:

an antenna substrate;

a feeding point;

a first conductor for receiving networking signals in the frequency range of about 4.9 GHz to about 5.875 GHz, the first conductor comprising a polygonal portion having a polygonal shape with an aspect ratio of length to width of less than about 5 to about 1;

the first conductor further comprising a strip portion having a width smaller than a width of the polygonal portion, a first end of the strip portion is connected to the feeding point, and a second end of the strip portion is connected to the polygonal portion;

wherein the polygonal portion comprises at least one notch where conducting material is removed from the polygonal portion for matching the impedance of the antenna; and a second conductor for receiving networking signals in the frequency range of about 2.4 GHz to about 2.5 GHz, the second conductor adopting a linear, space-filling, or grid dimension shape, and having a first end connected to the feeding portion.

2. The multi-band monopole antenna of claim 1, wherein the first conductor has an aspect ratio of less than about 3 to about 1.

3. The multi-band monopole antenna of claim 1, wherein the first conductor has an aspect ratio of less than about 2 to about 1.

4. The multi-band monopole antenna of claim 1, wherein the first conductor has an aspect ratio of about 3 to about 2.

5. The multi-band monopole antenna of claim 1, wherein the first conductor receives network signals in the 802.11a band.

6. The multi-band monopole antenna of claim 1, wherein the second conductor receives network signals in the 802.11bg band.

7. The multi-band monopole antenna of claim 1, wherein the substrate comprises a 10 mm×10 mm×0.8 mm circuit board with a copper base conductor.

8. The multi-band monopole antenna of claim 1, wherein the at least one notch is adjacent to a connection of the polygonal portion and the strip portion.

9. The multi-band monopole antenna of claim 1, wherein an end of the polygonal portion opposite to an end connected to the strip portion is closer to a second end of the second conductor than to the feeding point.

10. The multi-band monopole antenna of claim 1, wherein the strip portion is arranged at an angle with respect to a portion of the second conductor adjacent to the feeding point, the angle being smaller than about 90°.

11. A printed circuit board comprising at least one multi-band monopole antenna, the at least one multi-band monopole antenna comprising:

an antenna substrate;

a feeding point;

a first conductor for receiving networking signals in the frequency range of about 4.9 GHz to about 5.875 GHz, the first conductor comprising a polygonal portion having a polygonal shape with an aspect ratio of length to width of less than about 5 to about 1;

the first conductor further comprising a strip portion having a width smaller than a width of the polygonal portion, a first end of the strip portion is connected to the feeding point, and a second end of the strip portion is connected to the polygonal portion;

wherein the polygonal portion comprises at least one notch where conducting material is removed from the polygonal portion for matching the impedance of the antenna; and a second conductor for receiving networking signals in the frequency range of about 2.4 GHz to about 2.5 GHz, the second conductor adopting a linear, space-filling, or grid dimension shape, and having a first end connected to the feeding portion.

12. The printed circuit board of claim 11, wherein two or more multi-band monopole antennas are used and conducting material of a ground plane of the printed circuit board located between antenna attachment points of the two or more antennas is interrupted.

13. The printed circuit board of claim 11, further comprising a ground plane, wherein the at least one multi-band monopole antenna is mounted on a portion of the printed circuit board substantially free from the ground plane.

14. A symmetrical multi-band monopole antenna, comprising:

an antenna substrate;

a feeding point;

first and second conductors for receiving networking signals in the frequency range of about 4.9 GHz to about 5.875 GHz, each of the first and second conductors comprising a polygonal portion having symmetrical polygonal shapes with an aspect ratio of length to width of less than about 5 to about 1;

each of the first and second conductors further comprising a strip portion having a width smaller than a width of the polygonal portion, a first end of the strip portion of each of the first and second conductors is connected to the polygonal portion, and a second end of the strip portion of each of the first and second conductors is connected to the feeding point;

wherein the polygonal portion of each of the first and second conductors comprises at least one notch where conducting material is removed from the polygonal portion for matching the impedance of the antenna;

third and fourth conductors for receiving networking signals in the frequency range of about 2.4 GHz to about 2.5 GHz, the third and fourth conductors adopting linear, space-filling, or grid dimension shapes, and having a first end connected to the feeding point; and wherein the first and second conductors are symmetrically oriented with respect to each other about a central axis on the antenna substrate and the third and fourth conductors are symmetrically oriented with respect to each other about the central axis on the antenna substrate.

15. The symmetrical multi-band monopole antenna of claim 14, wherein the first and second conductors each have an aspect ratio of less than about 3 to about 1.

16. The symmetrical multi-band monopole antenna of claim 14, wherein the first and second conductors each have an aspect ratio of less than about 2 to about 1.

17. The symmetrical multi-band monopole antenna of claim 14, wherein the first and second conductors each have an aspect ratio of about 3 to about 2.

18. The symmetrical multi-band monopole antenna of claim 14, wherein the first and second conductor receives network signals in the 802.11bg band.

19. The symmetrical multi-band monopole antenna of claim 14, wherein the second and third conductors receive network signals in the 802.11bg band.

20. The symmetrical multi-band monopole antenna of claim 14, wherein the substrate comprises a 10 mm×10 mm×0.8 mm circuit board with a copper base conductor.

21. The symmetrical multi-band monopole antenna of claim 14, wherein the at least one notch of the polygonal portion is adjacent to a connection of the polygonal portion and corresponding strip portion.

22. The symmetrical multi-band monopole antenna of claim 14, wherein an end of the polygonal portion of the first or second conductor, the end being opposite to the end connected to the strip portion of the first or second conductor, is closer to an end of the third or fourth conductor than to the feeding point.

23. The symmetrical multi-band monopole antenna of claim 14, wherein the strip portion of the first conductor is arranged at a first angle with respect to a portion of the third conductor adjacent to the feeding point, the angle being smaller than about 90°.

24. The symmetrical multi-band monopole antenna of claim 14, wherein the strip portion of the second conductor is arranged at a second angle with respect to a portion of the fourth conductor adjacent to the feeding point, the angle being smaller than about 90°.

25. A printed circuit board comprising at least one symmetrical multi-band monopole antenna, the at least one symmetrical multi-band monopole antenna comprising:

an antenna substrate;

a feeding point;

first and second conductors for receiving networking signals in the frequency range of about 4.9 GHz to about 5.875 GHz, each of the first and second conductors comprising a polygonal portion having symmetrical polygonal shapes with an aspect ratio of length to width of less than about 5 to about 1;

each of the first and second conductors further comprising a strip portion having a width smaller than a width of the polygonal portion, a first end of the strip portion of each of the first and second conductors is connected to the polygonal portion, and a second end of the strip portion of each of the first and second conductors is connected to the feeding point;

wherein the polygonal portion of each of the first and second conductors comprises at least one notch where conducting material is removed from the polygonal portion for matching the impedance of the antenna;

third and fourth conductors for receiving networking signals in the frequency range of about 2.4 GHz to about 2.5 GHz, the third and fourth conductors adopting linear, space-filling, or grid dimension shapes, and having a first end connected to the feeding point; and wherein the first and second conductors are symmetrically oriented with respect to each other about a central axis on the antenna substrate and the third and fourth conductors are symmetrically oriented with respect to each other about the central axis on the antenna substrate.

26. The printed circuit board of claim 25, wherein two or more symmetrical multi-band monopole antennas are used and conducting material of a ground plane of the printed circuit board located between antenna attachment points of the two or more antennas is interrupted.

27. The printed circuit board of claim 25, further comprising a ground plane, wherein the at least one multi-band monopole antenna is mounted on a portion of the printed circuit board substantially free from the ground plane.

* * * * *